US012435924B2

(12) United States Patent
Guvelioglu et al.

(10) Patent No.: US 12,435,924 B2
(45) Date of Patent: Oct. 7, 2025

(54) MULTIPLE REFLUX STREAM HYDROCARBON RECOVERY PROCESS

(71) Applicant: LUMMUS TECHNOLOGY LLC, Bloomfield, NJ (US)

(72) Inventors: Galip Hakan Guvelioglu, The Woodlands, TX (US); Fereidoun Yamin, Houston, TX (US)

(73) Assignee: LUMMUS TECHNOLOGY LLC, Bloomfield, NJ (US)

( * ) Notice: Subject to any disclaimer, the term of this patent is extended or adjusted under 35 U.S.C. 154(b) by 420 days.

(21) Appl. No.: 17/155,320

(22) Filed: Jan. 22, 2021

(65) Prior Publication Data

US 2021/0231367 A1 Jul. 29, 2021

Related U.S. Application Data

(60) Provisional application No. 62/965,339, filed on Jan. 24, 2020.

(51) Int. Cl.
*F25J 3/02* (2006.01)

(52) U.S. Cl.
CPC ..... *F25J 3/0238* (2013.01); *F25J 3/0209* (2013.01); *F25J 3/0233* (2013.01); *F25J 2200/70* (2013.01); *F25J 2205/04* (2013.01); *F25J 2210/06* (2013.01); *F25J 2245/02* (2013.01)

(58) Field of Classification Search
CPC ..... F25J 3/0238; F25J 3/0209; F25J 3/0233; F25J 2200/70; F25J 2205/04; F25J 2210/06; F25J 2245/02; F25J 3/0242; F25J 2200/02; F25J 2200/50; F25J 2200/76; F25J 2240/02; F25J 2270/12; F25J 2270/60; F25J 2280/02
See application file for complete search history.

(56) References Cited

U.S. PATENT DOCUMENTS 4,157,904 A 6/1979 Campbell et al.
4,278,457 A 7/1981 Campbell et al.
(Continued)

FOREIGN PATENT DOCUMENTS

JP S62249936 A 10/1987
JP 2007510124 A 4/2007
(Continued)

OTHER PUBLICATIONS

International Search Report issued in International Application No. PCT/US2021/014542 dated May 6, 2021 (5 pages).
(Continued)

*Primary Examiner* — Jianying C Atkisson
*Assistant Examiner* — Ibrahim A. Michael Adeniji
(74) *Attorney, Agent, or Firm* — Osha Bergman Watanabe & Burton LLP

(57) ABSTRACT

Systems herein separate an inlet gas stream containing methane, C2 components, C3 components and optionally heavier hydrocarbons into a volatile gas fraction containing methane and a less volatile hydrocarbon fraction containing C2+ components. The system may include piping, valving, and controls configured to flexibly allow the system to operate in a high ethane recovery mode, a high throughput mode, or in some embodiments, a high propane recovery mode.

12 Claims, 2 Drawing Sheets

(56) References Cited

U.S. PATENT DOCUMENTS

| | | | | |
|---|---|---|---|---|
| 4,519,824 | A * | 5/1985 | Huebel | F25J 3/0238 62/621 |
| 4,698,081 | A | 10/1987 | Aghili | |
| 5,555,748 | A * | 9/1996 | Campbell | F25J 3/0242 62/621 |
| 5,568,737 | A | 10/1996 | Campbell et al. | |
| 5,881,569 | A | 3/1999 | Campbell et al. | |
| 6,244,070 | B1 | 6/2001 | Lee et al. | |
| 7,484,385 | B2 | 2/2009 | Patel et al. | |
| 7,793,517 | B2 | 9/2010 | Patel et al. | |
| 8,209,996 | B2 | 7/2012 | Mak | |
| 2002/0095062 | A1 * | 7/2002 | Paradowski | F25J 3/0238 208/340 |
| 2004/0159122 | A1 | 8/2004 | Patel et al. | |
| 2004/0172967 | A1 | 9/2004 | Patel et al. | |
| 2005/0204774 | A1 | 9/2005 | Foglietta et al. | |
| 2005/0229364 | A1 | 10/2005 | Chu | |
| 2009/0113931 | A1 * | 5/2009 | Patel | F25J 3/0233 62/620 |
| 2010/0043488 | A1 | 2/2010 | Mak et al. | |
| 2011/0067441 | A1 | 3/2011 | Martinez et al. | |
| 2013/0014390 | A1 | 1/2013 | Mak | |
| 2014/0075987 | A1 | 3/2014 | Mak | |
| 2014/0260420 | A1 * | 9/2014 | Mak | F25J 3/0238 62/620 |
| 2017/0051970 | A1 * | 2/2017 | Mak | F25J 3/0209 |
| 2019/0170435 | A1 | 6/2019 | Anguiano et al. | |
| 2021/0035798 | A1 | 2/2021 | Chen | |

FOREIGN PATENT DOCUMENTS

| | | | |
|---|---|---|---|
| JP | 4599362 | B2 | 12/2010 |
| JP | 2016066019 | | 4/2016 |
| JP | 2020184062 | | 11/2020 |
| KR | 20070011467 | A | 1/2007 |

OTHER PUBLICATIONS

Written Opinion issued in International Application No. PCT/US2021/014542 dated May 6, 2021 (4 pages).

International Preliminary Report on Patentability issued in International Application No. PCT/US2021/014542 dated Jul. 26, 2022 (5 pages).

Decision of Refusal issued in Japanese Application No. 2022-545066, mailed on Apr. 2, 2024 (6 pages).

Office Action issued in United Emirates Application No. P6001389/2022 mailed on Dec. 11, 2024 (9 pages).

Office Action issued in Japanese Application No. 2024-525012, mailed on May 7, 2025 (8 Pages).

* cited by examiner

MULTIPLE REFLUX STREAM HYDROCARBON RECOVERY PROCESS

FIELD OF THE DISCLOSURE

Embodiments herein relate to the recovery of ethane and heavier components from hydrocarbon gas streams. More particularly, embodiments herein relate to flexible recovery of ethane and heavier components from hydrocarbon streams, where the process may be readily transitioned from high throughput to high recovery modes.

BACKGROUND

Valuable hydrocarbon components, such as ethane, ethylene, propane, propylene and heavier hydrocarbon components, are present in a variety of gas streams. Some of the gas streams are natural gas streams, refinery off gas streams, coal seam gas streams, and the like. In addition, these components may also be present in other sources of hydrocarbons such as coal, tar sands, and crude oil, to name a few. The amount of valuable hydrocarbons varies with the feed source, and some of these streams may contain more than 50% methane and lighter components [i.e., nitrogen, carbon monoxide (CO), hydrogen, etc.], ethane, and carbon dioxide ($CO_2$). Propane, propylene and heavier hydrocarbon components generally make up a small amount of the overall feed. Due to the cost of natural gas, there is a need for processes that are capable of achieving high recovery rates of ethane, ethylene, and heavier components, while lowering operating and capital costs associated with such processes. Additionally, these processes need to be easy to operate and be efficient in order to maximize the revenue generated.

Several processes are available to recover hydrocarbon components from natural gas. These processes include refrigeration processes, lean oil processes, refrigerated lean oil processes, and cryogenic processes. Of late, cryogenic processes have largely been preferred over other processes due to better reliability, efficiency, and ease of operation. Depending on the hydrocarbon components to be recovered, i.e. ethane and heavier components or propane and heavier components, the cryogenic processes are different. Typically, ethane recovery processes employ a single tower with a reflux stream to increase recovery and make the process efficient such as illustrated in U.S. Pat. No. 4,519,824 (hereinafter referred to as "the '824 Patent"), U.S. Pat. Nos. 4,278,457, and 4,157,904. Depending on the source of reflux, the maximum recovery possible from the scheme may be limited. For example, if the reflux stream is taken from the hydrocarbon gas feed stream or from the cold separator vapor stream, or first vapor stream, as in the '824 Patent, the maximum recovery possible by the scheme is limited because the reflux stream contains ethane.

U.S. Pat. No. 5,568,737, a residue recycle process, discloses residue recycle to the top of the column as a first feed from top. The overhead of the cold separator is split into two streams, a portion is condensed and subcooled and introduced to the column as second feed from top. The second stream from overhead of the cold separator is introduced as the third feed from top after expansion with a turbo-expander or JT valve.

U.S. Pat. No. 7,793,517, which in FIG. 6 utilizes a configuration where the residue recycle and/or feed gas that can be fed to a reflux separator. U.S. Patent Application Publication No. 2019/0170435 in FIGS. 5-7 introduces feed gas as a second feed at the top of the column. Other patents and publications that relate to processing of light hydrocarbon streams may include U.S. Patent Application Publication Nos. 2014/0260420, 2014/0075987, 2013/0014390, 2010/0043488, 2005/0204774, 2004/0172967, 2004/0159122, and U.S. Pat. No. 6,244,070, among others.

SUMMARY OF THE DISCLOSURE

In one aspect, embodiments herein are directed toward a system for separating an inlet gas stream containing methane, C2 components, C3 components and optionally heavier hydrocarbons into a volatile gas fraction containing methane and a less volatile hydrocarbon fraction containing C2+ components. The system may include a splitter for dividing the inlet gas stream into a first feed stream and a second feed stream. A first heat exchanger may be provided for cooling the first feed stream, and a second heat exchanger may be provided for cooling the second feed stream. The system may also include a separator for separating the cooled first and second feed streams into a first vapor stream and a first liquid stream, as well as a flow line for feeding the first vapor stream to a demethanizer tower, and a flow line for feeding the first liquid stream to the demethanizer tower. The demethanizer tower may separate the feed streams into a demethanizer overheads stream and a demethanizer bottoms stream. One or more compressors may be provided for compressing the demethanizer overheads stream to form a residue gas stream, and a demethanizer tower reflux line may provide a reflux stream to a top of the demethanizer tower. A portion of the residue gas stream may be provided via a flow line to the demethanizer tower reflux line, and a flow line may provide a third portion of the inlet gas stream to the demethanizer tower reflux line. The system further includes a first valve for permitting or stopping a flow of the portion of the residue gas stream to the demethanizer tower reflux line, and a second valve for permitting or stopping a flow of the third portion of the inlet gas stream to the demethanizer tower reflux line.

In some embodiments, the system may further include a control system configured for controlling a position of the first and second valves.

The first heat exchanger may be a gas-gas heat exchanger configured for exchanging heat between one or more of the first feed stream, the demethanizer tower overheads stream, and the reflux stream. The second heat exchanger may be a reboiler configured for exchanging heat between one or more side draws from the demethanizer tower and the second feed stream.

In another aspect, embodiments herein may be directed toward a method for operating the system described above. The method may include closing the first valve and opening the second valve, and operating the system for a period of time in a high throughput mode, and closing the second valve and opening the first valve, and operating the system for a period of time in a high ethane recovery mode.

In yet another aspect, embodiments herein are directed toward a process for separating an inlet gas stream containing methane, C2 components, C3 components and optionally heavier hydrocarbons into a volatile gas fraction containing methane and a less volatile hydrocarbon fraction containing C2+ components. The process may include the steps of:

a. for a first time period, operating the process in a high ethane recovery mode, comprising:
   i. splitting an inlet gas stream into a first feed stream and a second feed stream and cooling the first and the second feed streams;

ii. separating the cooled first and second feed streams into a first vapor stream and a first liquid stream;

iii. expanding the first liquid stream thereby forming a first demethanizer tower feed stream;

iv. expanding the first gas stream to a lower pressure thereby forming a second demethanizer tower feed stream;

v. feeding the first and second demethanizer tower feed streams to a demethanizer, and separating the feed streams into a demethanizer overheads stream and a demethanizer bottoms stream;

vi. warming and compressing the demethanizer overheads stream to form a residue gas stream; and vii. recovering a first portion of the residue gas as a product stream and recycling a second portion of the residue gas stream as a reflux to the demethanizer tower;

b. discontinuing recycling of the second portion of the residue gas as reflux; and c. for a second time period, operating the process in a high throughput mode, comprising:

i. splitting the inlet gas stream into the first feed stream, the second feed stream, and a third feed stream, and cooling the first, the second, and the third feed streams;

ii. separating the cooled first and second feed streams into a first vapor stream and a first liquid stream;

iii. expanding the first liquid stream thereby forming a first demethanizer tower feed stream;

iv. expanding the first gas stream to a lower pressure thereby forming a second demethanizer tower feed stream;

v. feeding the first and second demethanizer tower feed streams to a demethanizer, and separating the feed streams into a demethanizer overheads stream and a demethanizer bottoms stream;

vi. warming and compressing the demethanizer overheads stream to form a residue gas stream recovered as a product; and vii. feeding the third feed stream as a reflux to the demethanizer tower.

The process, in other embodiments, may further include, for a third time period, operating the process in a C3+ recovery mode of operation while recovering less than 90% of ethane.

In yet another aspect, embodiments disclosed herein are directed toward a system for separating an inlet gas stream containing methane, C2 components, C3 components and optionally heavier hydrocarbons into a volatile gas fraction containing methane and a less volatile hydrocarbon fraction containing C2+ components. The system may include a splitter for dividing the inlet gas stream into a first feed stream and a second feed stream. A gas-gas heat exchanger may be provided for cooling the first feed stream and producing a cooled first feed stream. A second heat exchanger may be provided for cooling the second feed stream and producing a cooled second feed stream. The system may also include a first separator for separating the cooled first and second feed streams into a first vapor stream and a first liquid stream. A splitter may divide the first vapor stream into a first portion and a second portion, and an expander may be provided for expanding the first portion of the first vapor stream and for extracting work from the first portion of the first vapor stream. A flow line may be provided for cooling the second portion of the first vapor stream in the gas-gas heat exchanger, and a second separator may be provided to separate the cooled second portion of the first vapor stream into a second vapor stream and a second liquid stream. The system may also include: a flow line for feeding the first liquid stream to a demethanizer tower as a first tower feed stream; a flow line for feeding the expanded first portion of the first vapor stream to the demethanizer tower as a second tower feed stream; a flow line for feeding the second liquid stream to the demethanizer tower as a third feed stream; and a flow line for feeding the second vapor stream to the demethanizer tower as a fourth feed stream. The demethanizer tower may be configured to receive and separate the feed provided by the first, second, third, and fourth feed streams into a demethanizer overheads stream and a demethanizer bottoms stream. A flow line may be provided for warming the demethanizer overheads stream in the gas-gas exchanger, and one or more compressors may be provided for compressing the warmed demethanizer overheads stream to form a residue gas stream, at least one of the one or more compressors driven by the work extracted in the expander. A fifth tower feed stream may be configured for receiving (i) a portion of the residue gas stream, (ii) a third portion of the inlet gas stream, or (iii) a mixture of (i) and (ii), and for cooling the received (i), (ii), or (ii) in the gas-gas exchanger. Further, the system may include a reflux flow line for providing a reflux stream to a top of the demethanizer tower, wherein valving and piping are configured such that the reflux stream comprises either (i), (ii), or (iii) as provided from the fifth tower feed stream or the second vapor stream. A first valve may be provided for controlling or stopping a flow of the portion of the residue gas stream to the fifth tower feed line, and a second valve may be provided for controlling or stopping a flow of the third portion of the inlet gas stream to the fifth tower feed line.

Other aspects and advantages will be apparent from the following description and the appended claims.

DETAILED DESCRIPTION

Figure 1:
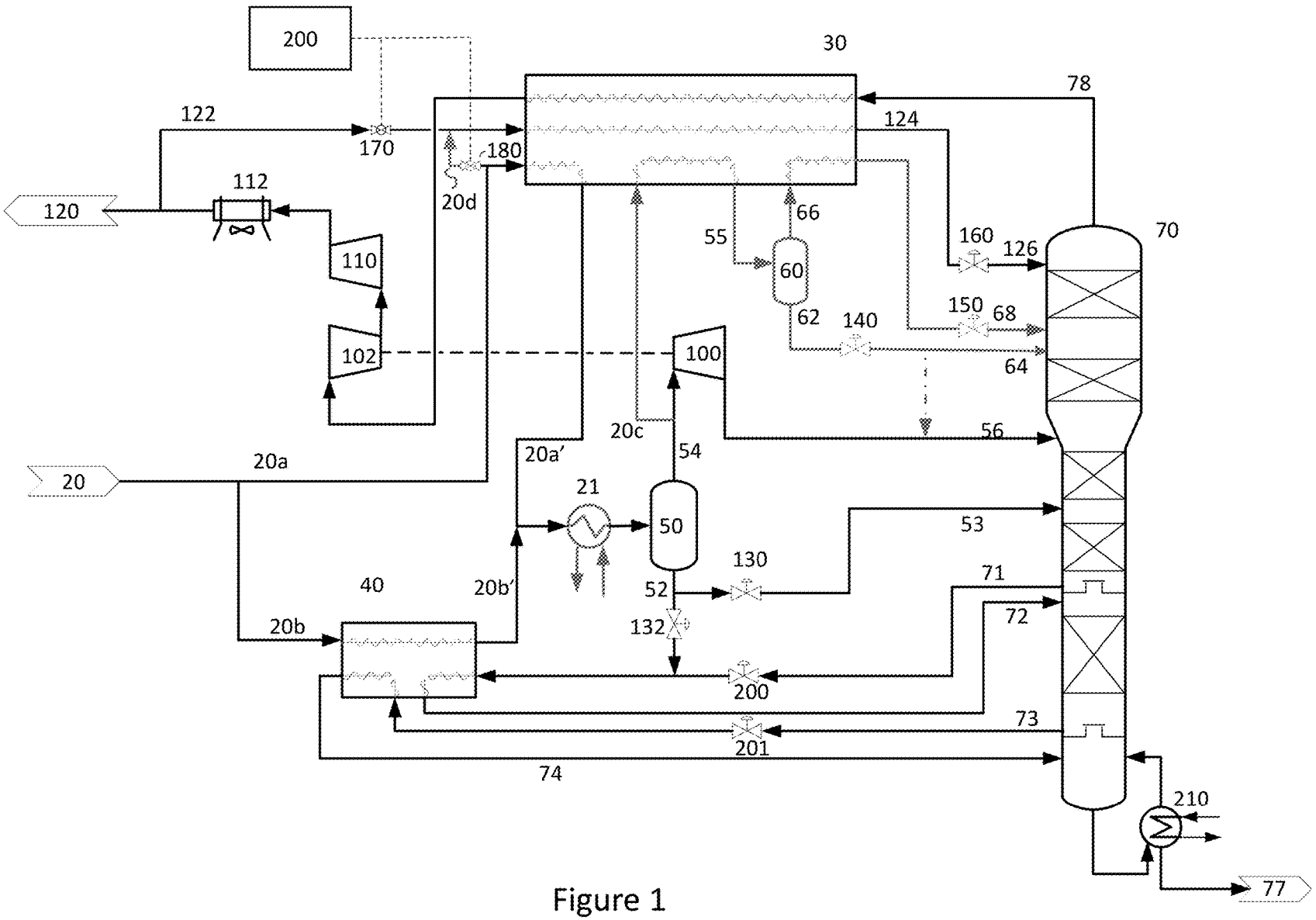
FIGS. 1 and 2 are simplified process flow diagrams of a C2+ recovery process in accordance with embodiments herein.

Embodiments herein are directed toward separating an inlet gas into lighter and heavier fractions. Inlet gas, as used herein, refers to a hydrocarbon gas, where such gas is typically received from a high pressure gas line and is substantially comprised of methane, with the balance being ethane, ethylene, propane, propylene, and heavier components, as well as carbon dioxide, nitrogen and other trace gases. The term "C2+ components" means all organic components having at least two carbon atoms, including aliphatic species such as alkanes, olefins, and alkynes, particularly, ethane, ethylene, acetylene and the like.

Systems according to embodiments herein for separating an inlet gas stream containing methane, C2 components, C3 components and optionally heavier hydrocarbons into a volatile gas fraction containing methane and a less volatile hydrocarbon fraction containing C2+ components may flexibly allow an operator to operate in a first mode, high throughput, and a second mode, high ethane recovery. Due to market demand or other factors, it may be desirable to operate in the high throughput mode or the high ethane recovery mode, and systems herein allow an operator to readily transition between modes of operation.

The system may include a splitter for dividing the inlet gas stream into a first feed stream and a second feed stream.

A first heat exchanger may be provided for cooling the first feed stream, and a second heat exchanger may be provided for cooling the second feed stream. A separator may receive the cooled first and second feed streams, and may then separate the cooled first and second feed streams into a first vapor stream and a first liquid stream.

A flow line may be provided for feeding the first vapor stream to a demethanizer tower. Likewise, a flow line for feeding the first liquid stream to the demethanizer tower. In the demethanizer tower, the feed gas may be separated into a demethanizer overheads stream, including the methane, and a demethanizer bottoms stream, including the C2+ components. One or more compressors may be provided for compressing the demethanizer overheads stream to form a residue gas stream.

A demethanizer tower reflux line may be used for providing a reflux stream to a top of the demethanizer tower. The system may also include a flow line for providing a portion of the residue gas stream to the demethanizer tower reflux line. A flow line may also be configured to provide a third portion of the inlet gas stream to the demethanizer tower reflux line. A first valve may be used for permitting or stopping a flow of the portion of the residue gas stream to the demethanizer tower reflux line, and a second valve may be used for permitting or stopping a flow of the third portion of the inlet gas stream to the demethanizer tower reflux line. A control system may be configured for controlling a position of the first and second valves. Closing the first valve and opening the second valve, using feed gas as reflux, results in the system operating in a high throughput mode. Closing the second valve and opening the first valve, using the residue gas as reflux, results in the system operating in a high ethane recovery mode.

Figure 2:
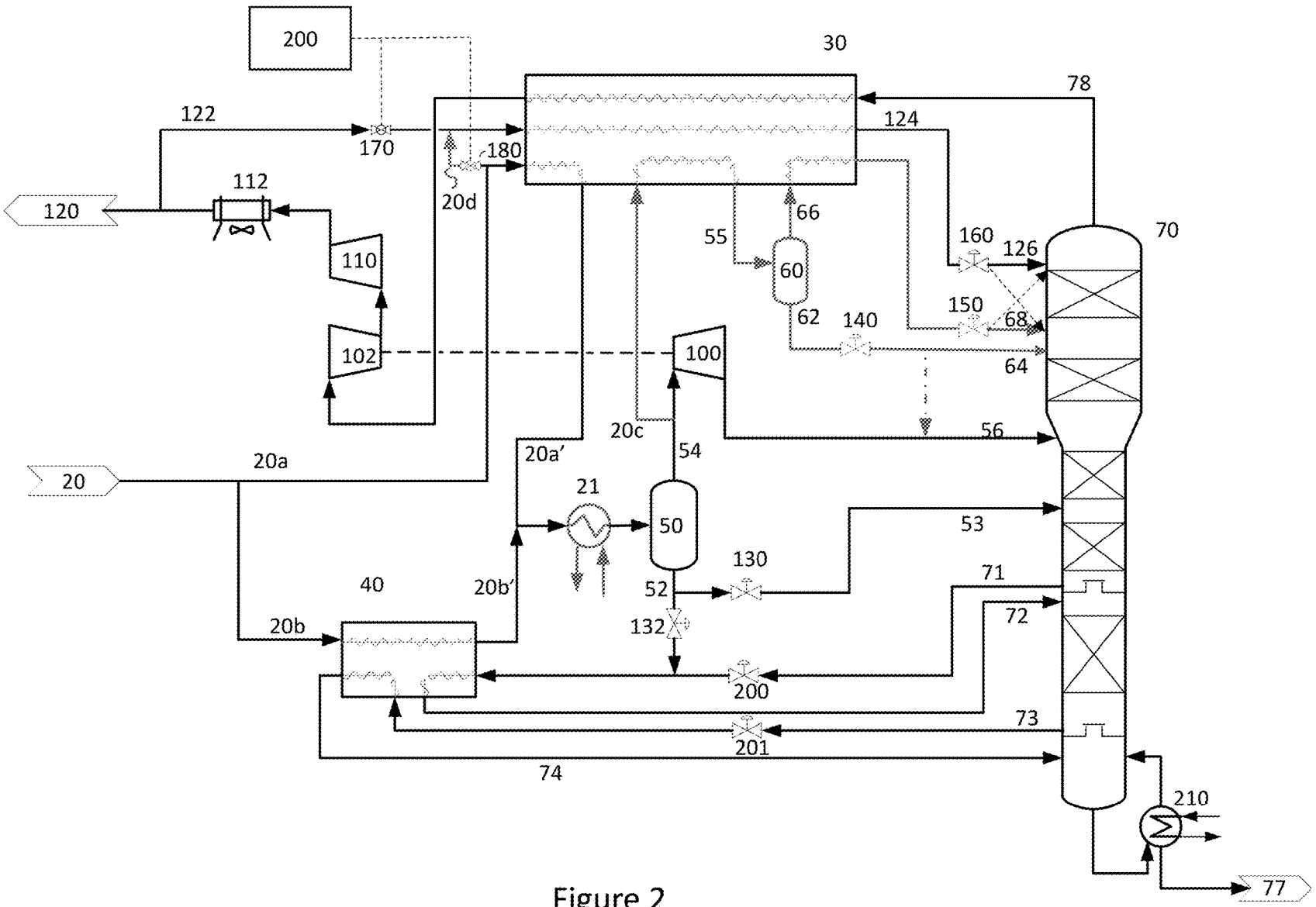

FIGS. 1 and 2 illustrate embodiments of the C2+ recovery systems herein, where like numerals represent like parts. Further, the following description associated with FIGS. 1 and 2 provide exemplary temperatures, pressures, or ranges for the same; where a range is provided for a pressure or temperature, it should be understood that the associated temperature or pressure may also be a range, even though only a single exemplary temperature or pressure may be recited. Further, it should be understood that the temperatures and pressures provided may vary based on the compositional makeup of the streams.

Referring now to FIGS. 1 and 2, a raw feed gas to the C2+ recovery system can contain certain impurities, such as water, CO2, H2S, and the like, that are detrimental to cryogenic processing. The raw feed gas stream may be treated to remove CO2 and H2S, if present in large quantities. This treated gas is then dried and filtered before being sent to the cryogenic section of the C2+ recovery system as inlet feed gas stream 20. Inlet feed gas stream 20 is split into first inlet stream 20*a*, which may contain a portion of the inlet feed gas stream flow, and a second inlet stream 20*b*, which contains a remainder of the inlet feed gas stream flow. First inlet stream 20*a* and second inlet stream 20*b* may be of equivalent compositional make-up.

First inlet stream 20*a* may be cooled in gas-gas heat exchanger 30 by heat exchange contact with cold streams to a temperature in the range of 0° F. to −60° F., for example −5° F. to −35° F., such as −20° F., to partially condense heavier hydrocarbons. Second inlet stream 20*b* may be cooled in demethanizer reboiler 40 by heat exchange contact with reboiler streams 71, 73 to a temperature in the range of 0° F. to −60° F., for example −5° F. to −35° F., such as −20° F., to partially condense heavier hydrocarbons. In all embodiments herein, gas-gas heat exchanger 30 and demethanizer reboiler 40 can be a single multi-path exchanger, a plurality of individual heat exchangers, or combinations and variations thereof.

Next, cooled inlet streams 20*a*', 20*b*' are combined and sent to a cold separator 50, which operates at about −20° F. (such as −10 to −30° F.), for example. Depending on the composition and feed pressure of inlet feed gas stream 20, some external cooling in the form of propane refrigeration could be required to sufficiently cool the inlet gas streams 20*a*', 20*b*', such as via optional propane refrigeration provided via exchanger 21. While propane refrigeration is indicated, any other cooling medium can be used instead of propane. Separator 50 may be a flash drum or a cold absorber, for example, and, in some embodiments, may include at least one mass transfer zone. In some embodiments, the mass transfer zone may be a tray or similar equilibrium separation stage or a flash zone.

Cold separator 50 produces a separator bottoms stream 52 and separator overhead stream 54. Separator bottoms stream 52 is expanded through a first expansion valve 130, such as to a pressure of about 330 psia (such as in the range from 275 psia to 500 psia), thereby cooling the stream to about −70° F., for example. This cooled and expanded stream is sent to demethanizer 70 as a first demethanizer, or tower, feed stream 53.

Separator overhead stream 54 may be essentially isentropically expanded in expander 100, such as to a pressure of about 325 psia. Due to the reduction in pressure and extraction of work from the stream, the resulting expanded stream 56 may be cooled to a temperature of about −91° F. (−80 to −100° F.), for example. The cooled, expanded stream 56 may then be sent to demethanizer 70. In some embodiments, stream 56 may be fed, for example, below a third tower feed stream 64, as a second tower feed stream, such as above first tower feed stream 53 and below a third tower feed stream 64. The work is later recovered in a booster compressor 102 driven by expander 100 to partially boost pressure of a demethanizer overhead stream 78. In some embodiments, a booster compressor (not shown) driven by expander 100 may be used to partially boost pressure of the inlet stream 20.

In some embodiments, a portion 20*c* of the overhead stream 54 may be withdrawn upstream of expander 100 and fed to an optional reflux separator 60. Third inlet vapor stream 20*c* may be cooled in gas-gas heat exchanger 30, such as to a temperature of about −30° F. to −70° F. and partially condensed via heat exchange contact with cold streams. The partially condensed stream may then be supplied to reflux separator 60 as intermediate reflux stream 55. Reflux separator 60 produces reflux separator bottoms stream 62 and reflux separator overhead stream 66. Reflux separator bottoms stream 62 may be expanded by a second expansion valve 140 and supplied to demethanizer 70, for example, below the fourth tower feed stream 68, as third tower feed stream 64. In addition, reflux separator overhead stream 66 may be further cooled in gas-gas heat exchanger 30 via heat exchange contact with cold streams, expanded by a third expansion valve 150, for example to a pressure in the range of about 300 to 500 psia, such as to a pressure of about 325 psia, thereby cooling the stream, such as to −148° F., and supplying the cooled expanded stream to demethanizer tower 70 as fourth tower feed stream 68, which may be introduced below demethanizer reflux stream 126. In some embodiments, expanded reflux separator bottoms stream 64 may be combined with stream 56 and fed to the demethanizer 70 as a combined second tower feed stream. In other embodiments, such as illustrated in FIG. 2, the system may be configured to include further flexibility by providing valving and flow lines to switch the feed point of the fourth tower feed stream 68 and the reflux stream 126, feeding stream 68 as reflux.

Demethanizer 70 may thus be supplied a second tower feed stream 56, a third tower feed stream 64, a fourth tower feed stream 68, and a demethanizer reflux stream 126, thereby producing demethanizer overhead stream 78, demethanizer bottoms stream 77, and one or more reboiler side streams 71, 73.

In demethanizer 70, rising vapors in first tower feed stream 53 are at least partially condensed by intimate contact with falling liquids from second tower feed stream 56, third tower feed stream 64, fourth tower feed stream 68, and demethanizer reflux stream 126, thereby producing demethanizer overhead stream 78 that contains a substantial amount of the methane and lighter components from inlet feed gas stream 20. Condensed liquids descend down demethanizer 70 and are removed as demethanizer bottoms stream 77, which contains a major portion of ethane, ethylene, propane, propylene and heavier components from inlet feed gas stream 20. Ethane recovery, as used herein, refers to the amount of ethane recovered via demethanizer bottoms stream 77 as compared to the amount of ethane in feed 20.

Reboiler streams 71, 73 may be removed from demethanizer 70 in the lower half of the vessel. Further, reboiler streams 71, 73 may be warmed in demethanizer reboiler 40 and returned to demethanizer as reboiler reflux streams 72, 74, respectively. The side reboiler design allows for the recovery of refrigeration from demethanizer 70.

Demethanizer overhead stream 78 is warmed in gas-gas heat exchanger 30, such as to a temperature of about 90° F. (80-100° F., for example). After warming, demethanizer overhead stream 78 is compressed in booster compressor 102, such as to a pressure of about 380 psia (350 psia to 400 psia, for example), by power generated by the expander 100. Intermediate pressure residue gas is then sent to residue compressor 110 where the pressure is raised, such as to a pressure above 800 psia or pipeline specifications, to form residue gas stream 120. Next, to relieve heat generated during compression, residue aftercooler 112 cools residue gas stream 120. Residue gas stream 120 may be, for example, a pipeline sales gas that contains a substantial amount of the methane and lighter components from inlet feed gas stream 20, and a minor portion of the C2+ components and heavier components.

Embodiments herein may additionally allow flexible operations, permitting an operator to operate in a high recovery mode and a high plant throughput mode.

In a high recovery mode, at least a portion of residue gas stream 120 may be returned to the process to produce a residue gas reflux stream 122. This residue gas reflux stream 122 may be cooled in gas-gas heat exchanger 30, such as to a temperature in the range of −80 to −150° F. via heat exchange contact with cold streams to substantially condense the stream. Next, this cooled residue gas reflux stream 124 is expanded through a fourth expansion valve 160, such as to a pressure of about 325 psia (275 to 500 psia), whereby it may be cooled, such as to a temperature of about −157° F., and sent to demethanizer 70 as a demethanizer reflux stream 126. In some embodiments, demethanizer reflux stream 126 is sent to demethanizer 70 above fourth tower feed stream 68 as top feed stream to demethanizer 70.

In a high throughput mode, the residue recycle 122 may be discontinued, such as by closing a valve 170. As reflux to demethanizer 70, a fourth portion 20*d* of the inlet feed gas may be provided by opening a valve 180, providing inlet gas to the reflux line, which may be cooled in gas-gas heat exchanger 30 via heat exchange contact with cold streams. Next, this cooled feed gas reflux stream 124 is expanded through fourth expansion valve 160 whereby the feed gas reflux may be cooled and fed to demethanizer 70 as demethanizer reflux stream 126. The reflux in such embodiments has the same composition as the feed.

In the high recovery mode, a portion of the residue gas after compression may be recycled in the recovery processes as a top reflux/feed stream to enhance the recovery of ethane and propane. The recycled residue gas (stream 122) may be, for example, from about 10% to more than 30% of the residue gas leaving the compression (102, 110).

In the high throughput mode, the residue recycle is advantageously eliminated, allowing the unit to process more gas. The excess dry feed gas is routed to the residue recycle flow pass and utilizes the same reflux feed configuration. This configuration allows this option to utilize the same equipment (reflux lines, expansion valves, expander, heat exchangers and compressors) while overall processing more gas through the unit.

A control system 200 may be provided for controlling a position of valves 170, 180, in some embodiments. When it is desired to operate in a high throughput mode, valve 170 may be closed and valve 180 opened, thereby feeding a portion of the feed gas as reflux to the demethanizer tower. When it is desired to operate in a high ethane recovery mode, valve 180 may be closed and valve 170 opened, thereby feeding a portion of the residue gas as reflux to the demethanizer tower. In this manner, the system may be readily transitioned between the modes of operation.

When it is desired to operate the system in a high ethane recovery mode, the system (valving, controls, etc.) may be configured to use residue gas as reflux to the demethanizer tower. The high ethane recovery mode for the separation process may thus include splitting an inlet gas stream into a first feed stream and a second feed stream and cooling the first and the second feed streams. The cooled first and second feed streams may then be separated into a first vapor stream and a first liquid stream. The first liquid stream may be expanded, thereby forming a first demethanizer tower feed stream, and the first gas stream may be expanded to a lower pressure thereby forming a second demethanizer tower feed stream. The first and second demethanizer tower feed streams may then be fed to a demethanizer, separating the feed streams into a demethanizer overheads stream and a demethanizer bottoms stream. Warming and compressing the demethanizer overheads stream may form a residue gas stream, a first portion of which may be recovered as a product stream, and a second portion of which may be fed as a reflux to the demethanizer tower.

When it is desired to operate the system in a high throughput mode, the system (valving, controls, etc.) may be configured to use feed gas as reflux to the demethanizer tower. The high throughput mode for the separation process may thus include splitting the inlet gas stream into the first feed stream, the second feed stream, and a third feed stream, and cooling the first, the second, and the third feed streams. Similar to the high ethane recovery mode, the first and second feed streams may be separated into a first vapor stream and a first liquid stream, which may each be expanded and fed to the demethanizer tower as feed streams, and the feed may be separated in the demethanizer tower into a demethanizer overheads stream and a demethanizer bottoms stream. Warming and compressing the demethanizer overheads stream may form a residue gas stream, recovered as a product. Instead of using residue gas as reflux, the third feed stream may be fed as a reflux to the demethanizer tower, enabling the system to operate in the high throughput mode.

In other embodiments, such as where it is desired to increase throughput while achieving a relatively high ethane recovery, control system 200 may also be configured to operate valves 170 and 180 such that a combined feed of residue gas 122 and feed 20*d* may be provided as reflux to the demethanizer tower.

In yet other embodiments, the system may be configured to operate in a C3+ recovery mode of operation. In the C3+ recovery mode, valve 130 can be partially or fully closed, with valve 132 at least partially or fully open, thereby providing at least a portion or a whole of the liquid feed from separator 50 to reboiler 40. Valve 200 may be closed, thereby not withdrawing a side draw via flow line 71, but rather providing liquid hydrocarbons via flow line 52 as the feed to this lower portion of the column. Valve 201 can be open or closed, depending on the ethane recovery desired, where greater than 20% ethane recovery may be achieved with valve 201 open. Supplemental heat may be provided by trim reboiler 210, which may use residue recycle 122, an external heat source such as steam or hot oil, or other suitable process stream(s) as a heat source. Such a flow scheme may provide for the ability to recover a high amount of the C3+ components, such as greater than 95% or greater than 98% of C3+ hydrocarbons in the feed, although ethane recovery may be decreased, such as to less than 90% ethane recovery.

As described above, embodiments herein allow gas plant operators to choose between high ethane recovery and high plant throughput. Providing the rich feed gas as top reflux is not an obvious location as it reduces the recovery. However, such provides an advantage of operational flexibility. With minimal capital spending, an additional 15-20% feed gas can be processed. Overall the natural gas liquids product recovered is higher even at a lower percentage recovery. This provides significant advantage to gas plant operators when they want to maximize plant throughput.

The two operating modes were simulated, one using residue gas recycle as reflux to the demethanizer, the other using a portion of the feed gas as reflux to the demethanizer. The simulations resulted are presented in Table 1.

TABLE 1

| | High Recovery Mode | High Throughput Mode |
|---|---|---|
| Capacity, MMSCFD | 200 | 240 |
| Ethane Recovery | 97% | 92% |
| Total Power, hp | 16,180 | 17,500 |
| NGL Product, BPD | 25,606 | 29,804 |

The richer feed gas, when used as top reflux results in lower ethane recovery (92% vs. 97%). However, the use of richer feed gas as top reflux may allow a significant increase in throughput (200 million standard cubic feet per day versus 240 million standard cubic feet per day, a 20% increase in throughput at simulated conditions).

Unless defined otherwise, all technical and scientific terms used have the same meaning as commonly understood by one of ordinary skill in the art to which these systems, apparatuses, methods, processes and compositions belong.

The singular forms "a," "an," and "the" include plural referents, unless the context clearly dictates otherwise.

As used here and in the appended claims, the words "comprise," "has," and "include" and all grammatical variations thereof are each intended to have an open, non-limiting meaning that does not exclude additional elements or steps.

"Optionally" means that the subsequently described event or circumstances may or may not occur. The description includes instances where the event or circumstance occurs and instances where it does not occur.

When the word "approximately" or "about" are used, this term may mean that there can be a variance in value of up to +10%, of up to 5%, of up to 2%, of up to 1%, of up to 0.5%, of up to 0.1%, or up to 0.01%.

Ranges may be expressed as from about one particular value to about another particular value, inclusive. When such a range is expressed, it is to be understood that another embodiment is from the one particular value to the other particular value, along with all particular values and combinations thereof within the range.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for separating an inlet gas stream containing methane, C2 components, C3 components and optionally heavier hydrocarbons into a volatile gas fraction containing methane and a less volatile hydrocarbon fraction containing C2+ components, the process comprising the steps of:

for a first time period, operating the process in a high ethane recovery mode, comprising:

(a) splitting an inlet gas stream into a first feed stream and a second feed stream and cooling the first and the second feed streams to form a cooled first feed stream and a cooled second feed stream;

(b) separating the cooled first and second feed streams into a first vapor stream and a first liquid stream;

(c) expanding the first liquid stream thereby forming a first demethanizer tower feed stream;

(d) expanding the first vapor stream to a lower pressure thereby forming a second demethanizer tower feed stream;

(e) feeding the first and second demethanizer tower feed streams to a demethanizer tower, and separating the feed streams into a demethanizer overheads stream and a demethanizer bottoms stream;

(f) warming and compressing the demethanizer overheads stream to form a residue gas stream; and (g) recovering a first portion of the residue gas stream as a product stream and recycling a second portion of the residue gas stream to the demethanizer tower;

stopping recycling of the second portion of the residue gas; and for a second time period, operating the process in a high throughput mode, comprising:

(aa) splitting the inlet gas stream into the first feed stream, the second feed stream, and a third feed stream, wherein the third feed stream has a composition substantially the same as the inlet gas stream;

(bb) cooling the first, the second, and the third feed streams to produce the cooled first feed stream, the cooled secon feed stream, and a cooled third feed stream;

(cc) separating the cooled first and second feed streams into the first vapor stream and the first liquid stream;

(dd) expanding the first liquid stream thereby forming the first demethanizer tower feed stream;

(ee) expanding the first vapor stream to a lower pressure thereby forming the second demethanizer tower feed stream;

(ff) feeding the first demethanizer tower feed stream, the second demethanizer tower feed stream, and the cooled third feed stream to the demethanizer tower, and separating the feed streams into the demethanizer overheads stream and the demethanizer bottoms stream;

(gg) warming and compressing the demethanizer overheads stream to form the residue gas stream recovered as the product.

2. The process of claim 1, further comprising, for a third time period, operating the process in a C3+ recovery mode of operation while recovering less than 90% of ethane.

3. The process of claim 1, further comprising, for a third time period, mixing a portion of the residue gas and the third feed stream to form a mixed stream, and feeding the mixed stream to the demethanizer tower.

4. The process of claim 1, further comprising mixing the cooled first and second feed streams, to produce a mixed cooled feed stream.

5. The process of claim 1, further comprising exchanging heat between the first feed stream and the demethanizer overheads stream.

6. The process of claim 3, further comprising exchanging heat between one or more of the first feed stream, the demethanizer overheads stream, and the mixed stream.

7. The process of claim 1, wherein the operating the process in a high throughput mode is effected via the closing of a first valve to stop the recycling of the second portion of the residue gas as reflux and the opening of a second valve to split the inlet gas stream.

8. The process of claim 3, wherein the ethane recovery during the high throughput mode is at least 92%.

9. The process of claim 1, further comprising cooling a second portion of the first vapor stream to form a cooled second portion.

10. The process of claim 9, further comprising:

separating the cooled second portion into a second vapor stream and a second liquid stream;

feeding the second vapor stream to the demethanizer tower; and feeding the second liquid stream to the demethanizer tower.

11. The process of claim 9, further comprising:

separating the cooled second portion into a second vapor stream and a second liquid stream;

exchanging heat between the second vapor stream and the demethanizer overheads stream, forming a cooled stream, expanding the cooled stream to form an expanded stream, and feeding the expanded stream to the demethanizer tower; and feeding the second liquid stream to the demethanizer tower.

12. The process of claim 11, wherein the expanded stream is fed as a reflux stream to the demethanizer tower.

* * * * *